United States Patent [19]

Bernhardt

[11] 4,211,481

[45] Jul. 8, 1980

[54] TANK FOR DEVELOPING COLOR FILMS

[75] Inventor: Rainer Bernhardt, Bergneustadt, Fed. Rep. of Germany

[73] Assignee: Johannes Bockemuehl, Gummersbach, Fed. Rep. of Germany

[21] Appl. No.: 946,450

[22] Filed: Sep. 25, 1978

[30] Foreign Application Priority Data

Sep. 29, 1977 [DE] Fed. Rep. of Germany ..... 2743791

[51] Int. Cl.[2] ..... G03D 13/04

[52] U.S. Cl. ..... 354/312; 354/313; 354/331; 220/85 B

[58] Field of Search ..... 354/297, 300, 307, 331, 354/332, 333, 334, 335, 336, 337, 338, 310, 311, 312, 313, 314, 315; 220/85 B, 361, 362, 367, 368, 203; 206/455, 456

[56] References Cited

U.S. PATENT DOCUMENTS

| | | | |
|---|---|---|---|
| 1,615,880 | 2/1927 | Lucas | 354/310 |
| 1,666,666 | 4/1928 | Pew | 220/85 B |
| 1,869,938 | 8/1932 | Ingram | 220/203 |
| 2,307,043 | 1/1943 | Hothersall | 220/367 |
| 2,732,873 | 1/1956 | Treiber | 220/85 B |
| 2,948,432 | 8/1960 | Bodley et al. | 220/85 B |
| 3,055,536 | 9/1962 | Dieny | 220/203 |
| 3,435,301 | 3/1969 | Oehme | 220/203 |
| 3,490,488 | 1/1970 | Grist | 220/203 |
| 4,060,175 | 11/1977 | Rysgaard | 220/85 B |

FOREIGN PATENT DOCUMENTS

| | | | |
|---|---|---|---|
| 2431648 | 5/1976 | Fed. Rep. of Germany | 354/307 |
| 6402982 | 9/1964 | Netherlands | 220/85 B |

*Primary Examiner*—L. T. Hix
*Assistant Examiner*—Alan Mathews
*Attorney, Agent, or Firm*—Michael J. Striker

[57] ABSTRACT

A tank includes a housing having an interior in which gas is likely to evolve and an opening communicating with the interior. The opening is closed by a removable cover which tends to become dislodged from the housing under the pressure of gas evolving in the interior. The cover compensates for the pressure exerted by gas, thus preventing dislodging of the same from the housing.

13 Claims, 7 Drawing Figures

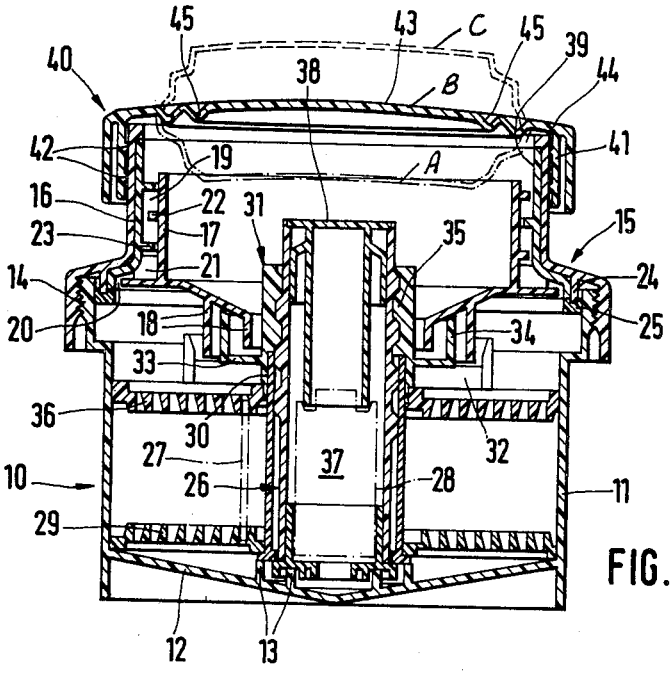
FIG. 1
FIG. 2
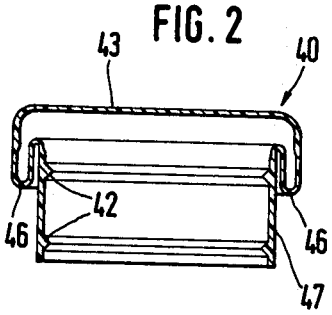
FIG. 4
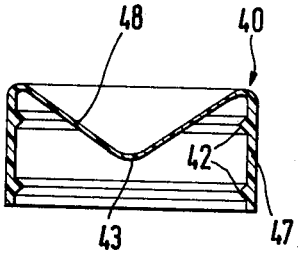
FIG. 6
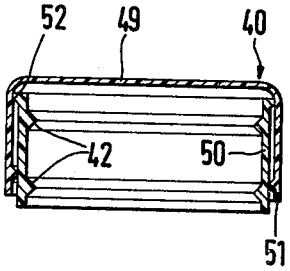
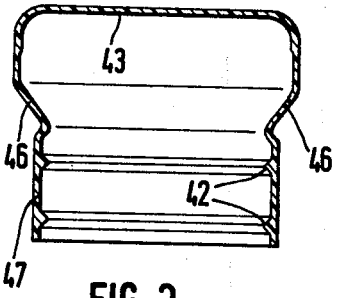
FIG. 3
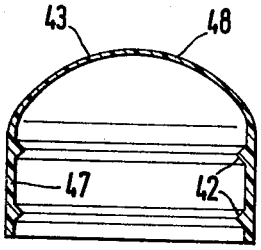
FIG. 5
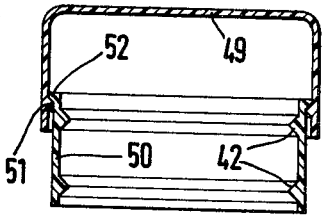
FIG. 7

TANK FOR DEVELOPING COLOR FILMS

BACKGROUND OF THE INVENTION

The present invention relates to film-developing tanks. More particularly, this invention concerns the color film developing tanks.

It is known in the art of film-developing tanks to provide a tank with a removable cover to close the corresponding opening of the tank. This opening is designed to introduce therethrough into the interior of the tank a film to be developed and a developing liquid.

The tank usually includes a lower part, that is a base, and a removable upper part, that is a removable cap, which is to be installed (i.e., threaded) on the lower part after the film to be developed is inserted in the same.

The cover is designed to be removably installed on the upper part of the tank. Thus, by taking off the cover one can very quickly and easily fill or empty the tank with the developing liquid without withdrawing every time the upper part of the tank itself. Besides that, even with the withdrawn cover of the tank the film can safely remain in the tank without being spoiled by an inadvertent exposure. In order to insure this, the upper part is provided with a labyrinth sealing arrangement which overlaps the corresponding opening of the tank thus preventing any undesired light penetration in the interior of the tank in general, and onto the developing film reel in particular.

During the developing process gas is likely to evolve (particularly, when a color film is developed) in the interior of the tank. The pressure of the gas acts against the walls of the container, including the cover, thus tending to undesirably dislodge the latter from the tank. Should it be the case, then the developing liquid may splash out the tank resulting in undesired consequences, such as for example fouling of the laboratory devices. Besides that, the amount of the developing liquid inside the tank decreases correspondingly by the amount of the liquid left in the tank, thus making the developing mistakes very likely to occur.

It is a common practice in order to compensate for the unavoidable gas pressure from inside the tank to open the cover from time to time during the developing process to relieve the gas pressure from the interior of the tank.

It is to be mentioned, however, that since a present developing process includes a number of such developing baths, it is a very cumbersome taks on part of the operator to accomplish such a manual degassing of the film-developing tanks during the developing process.

SUMMARY OF THE INVENTION

It is a general object of the present invention to avoid the disadvantage of the prior art film-developing tanks.

More particularly, it is an object of the present invention to provide a developing tank with such a cover which would compensate for the gas pressure created in the interior of the tank during the developing process without taking off the cover.

In pursuance of these objects and others which will become apparent hereafter, one feature of the present invention resides in providing a housing having an interior in which gas is likely to evolve and an opening communicating with said interior with a removable cover normally closing said opening and tending to become dislodged from the housing under the pressure of gas evolving in said interior. One of the main advantageous features of the present invention is to provide means for preventing dislodging of said cover by compensating for the pressure exerted by the gas evolving in said interior.

In accordance with the present invention, the cover is provided with an elastomeric portion which under the pressure exerted by gas evolving in said interior would bulge outwardly so as to increase the volume of the interior of the housing to thereby compensate for the gas pressure. It is to be mentioned that the expansion of this portion, which consequently results in the corresponding increasing of the interior volume of the tank, depends directly on the actual magnitude of the gas pressure evolving in the interior. This feature renders it possible on the one hand to avoid any withdrawal of the cover from the tank in order to relieve the gas pressure and on the other hand to eliminate any possibility of having the cover dislodged from the tank under the pressure of gas evolving in the interior thereof.

Another advantageous feature of the present invention is that having the cover simply withdrawn from the tank the operator can very quickly and easily fill (or empty) the tank with the developing liquid without permitting any light penetration in the interior of the tank, especially onto the film developing reel.

In accordance with one embodiment of the present invention, the bulging portion of the cover is provided with bellows. This portion is connected with the circumferential side wall of the cover. The bellows permit this portion of the cover to bulge very easily in one or another direction (i.e., upwardly and downwardly) relative to the normal position of this portion (i.e., horizontal). Thus, it becomes possible to obtain even an additional enlargement of the interior volume of the tank. In order to accomplish this, the expandable portion of the cover is bulged inwardly into the interior of the tank at the beginning of the developing process. Consequently, when said portion under the pressure of gas evolving in the interior bulges upwardly there can be obtained an increase of the interior volume twice as much as that should this portion be flat and normal to the vertical axis of the tank at the beginning of the developing process.

There may be a situation in which the bulging of the expandable portion is not possible at the beginning of the developing process due to a certain space proportion in the interior of the tank. In order to obtain a relatively large increase of the interior volume in such a situation the cover can be provided with an annular casing portion connected to the side walls of the cover. Thus, when said annular portion is expanded (i.e., bulged) the whole cross-sectional volume of the corresponding pressure compensating chamber is increased.

In order to use the whole cross-sectional volume of the interior of the pressure compensating chamber on the one hand and additionally increase the pressure compensating chamber on the other hand the expanding portion of the cover is formed as a diaphragm. Although the expanding portion of the cover can be glued or welded to the same wall of the cover (thus making it very simple and convenient to manufacture the whole cover) it is preferrable to manufacture the cover as one piece, that is the expanding portion is integrally connected to the side wall of the cover.

In accordance with another embodiment of the present invention the cover may be provided with a hood telescopically mounted on the circumferential side wall of the cover for telescopical movement relative thereto under the pressure of gas evolving in said interior, thus increasing the interior volume of said pressure compensating chamber. In this case the circumferential side wall of the cover is sealingly mountable on the upper part of the tank. In order to prevent dislodging of the hood from the side wall of the cover during the telescopical sliding movement of the hood along the side wall, the latter is provided at the upper end portion thereof with a circumferential projection extending outwardly from the outer surface of the side wall of the cover. The circumferential projection is adapted to abut the corresponding inwardly extending projection on the inner surface of the hood at the lower end portion thereof, thus preventing dislodging of the hood from the side wall of the cover.

In order to obtain a reliable sealing engagement between the cover and the upper portion of the tank, the inner surface of the cover is correspondingly provided with a number of circumferential sealing washers which tightly embrace the outer surface of the upper part of the tank when the cover is in assembly with the tank. Such a sealing engagement renders it possible to unhesitatingly bring the horizontally positioned tank in rotation without having any fears of undesired leakage of the developing liquid from the tank between the engaged surfaces of the cover and the upper portion of the tank.

Such a cover renders it possible on the one hand to save time and troublesome check manipulations with the cover itself during the developing process. On the other hand any developing mistakes and fouling of the laboratory devices by means of the developing liquid splashed out of the tank are entirely eliminated. Besides that, due to the pressure of gas evolving from the interior of the tank the developing process becomes visually readable for the operator simply by looking upon the changes of the expanding portion of the cover or in case it is dark in the laboratory by simply touching the expanding portion of the cover.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a cross-sectional view of a developing tank with a first embodiment of the cover in accordance with the present invention;

FIG. 2 is a cross-sectional view of a second embodiment of the cover in an initial position thereof;

FIG. 3 is a cross-sectional view of the embodiment of the cover shown in FIG. 2 in an eventual (i.e., expanded) position thereof;

FIG. 4 is a cross-sectional view of a third embodiment of the cover in an initial (i.e., bulged inwardly) position thereof;

FIG. 5 is a cross-sectional view of the embodiment of the cover shown in FIG. 4 in an eventual (i.e., bulged outwardly) position thereof;

FIG. 6 is a cross-sectional view of a fourth embodiment of the cover in an initial position thereof; and FIG. 7 is a cross-sectional view of the embodiment shown in FIG. 6 in an eventual (i.e., extended) position thereof.

DESCRIPTION OF THE PREFERRED EMBODIMENTS

Referring now to the drawings and first to FIG. 1 thereof, it may be seen that the reference numeral 10 designates a tank in toto having a cylindrical wall 11 defining an interior of the tank 10. The tank 10 is provided with a flat frustum-shaped bottom 12 which has two light-penetration preventing annular ribs 13. The ribs 13 are concentrically located on the bottom 12. The annular wall 11 is provided at its upper end with an enlarged portion having an outer thread 14 which receives a two-membered screw cap 15. The cap 15 has a flange having an inner thread engaging with the outer thread portion 14 when the cap 15 is in assembly on the annular wall 11. The cap 15 has a first insert sleeve 16 and a second insert sleeve 17 concentric with the first sleeve 16. The second sleeve 17 has a funnel-shaped bottom with two annular light-penetration proof ribs 18 located at the lower end portion of the funnel-shape bottom thereof. The sleeves 16 and 17 bound a passage between each other designated by a reference numeral 19, merging into an annular channel 20 between the cylindrical portions of the sleeves 16 and 17. The sleeves 16 and 17 are connected with one another by means of baffles 21 which are spaced one from another and extend across the passage 19 between the sleeves 16 and 17. The inner surface of the sleeve 16 and the outer surface of the sleeve 17 (that is the surfaces facing each other) are provided with a number of rims 23 and 22 respectively which are spaced from one another along the length of the passage 19 and extend partially across the passage 19 so as to overlap one another. Such a location of the rims 23 and 22 relative to one another prevents any light penetration through the passage 19 into the interior of the tank 10. The passage 19 and the channel 20 serve to ensure fast filling or emptying of the developing liquid therethrough in/from the tank 10. The first sleeve 16 is provided at its lower inner portion with an annular rim 24 which has a sealing washer 25 located between the rim 24 and the inner surface of the thread portion 14. A two-piece slotting cartridge 26 is located on the bottom 12 between the ribs 13. The cartridge 26 defines a place for installing a film reel 28 with a film 27 to be developed in the tank 10. The cartridge 26 is fixedly connected with a flat spiral disc 29. The lower end face of the slotting cartridge 26 is provided with projections which interengage the corresponding projections of the tank bottom 12 so as to prevent the rotation of the cartridge 26 relative to the bottom 12. The upper outer portion of the cartridge 26 is provided with a number of oblong holes (not shown) which extend in circumferential direction of the cartridge 26. This portion of the cartridge 26 is operative to receive thereon a hollow cylindrical neck 30 of a threaded sleeve 31. The neck 30 is also provided with oblong holes which coincide with the oblong holes of the cartridge 26 when the latter is in assembly with the sleeve 31. These holes receive baffles extending from the outer side of the upper portion of the cartridge 26 inwardly into the interior of the tank 10. The baffles belong to an elastomeric deformable locking ring 32 which couples the threaded sleeve 31, which is rotatable in axial direction, with the slotting cartridge 26 which is rotatably-free.

The coupling can be dissolved by means of elastomeric deformation of the baffles (that is withdrawal from the holes) of the locking ring 32. The hollow cylindrical neck 30 of the threaded sleeve 31 is located on a flat annular wall 33. The wall 33 has on the one hand an outside circumferential light-penetration proof rim 34 and on the other hand an inside shaft 35 which in its turn is provided with an inner course-threaded portion. The threaded sleeve 31 is fixedly connected to the upper flat spiral disc 36. The light-penetration proof rim 34 extends between the rims 18 of the screw cap 15. The inner surface of the slotting cartridge 26 defines the interior 37 thereof designed for receiving therein the film reel 28, which interior is closed from above by a lid 38.

The sleeve 16 of the cap 15 defines an opening which is closed by a removable cover 40. The cover 40 is provided with an annular casing 41 having sealing circumferential elements 42 which tightly embrace from outside the first sleeve 16 so as to prevent any leakage of the developing liquid from the interior of the tank 10. Such a cover can be very quickly removed from the cap 15 in order to introduce the developing liquid inside or withdraw the same from the tank 10, without permitting light penetration into the interior of the tank 10, that is between the flat spiral discs 29 and 36 and onto the film reel space 37 in particular.

The cover 40 is provided with a wall portion 43, which in the embodiment shown in FIG. 1 is located in the middle of the cover wall 44 and is connected by means of bellows 45 with the side wall of the cover. At least this portion 43 is made of elastomeric material, however the whole cover 40 may be made as one-piece member of elastomeric material. In this case the portion 43 is integrally connected to the cover wall 44. The bellows 45 have a thickness less than that of the portion 43 and the cover wall 44. At the beginning of the developing process in the tank 10, the portion 43 may be pressed in a position A inwardly in direction inside the interior of the tank 10.

The gas evolving in the interior of the tank during the developing process pressure the portion 43 upwardly relative to a middle position B thereof and outwardly in an expanded position C. Thus, the interior volume of the tank 10 between the initial position A and the expanded position C is correspondingly enlarged so as to compensate for the pressure exerted by the gas in the interior of the tank 10.

FIG. 2 and 3 show another embodiment of the cover 40, which has the expandable portion 43 connected to a neck wall 47 by means of a weakened annular portion 46. Before the developing process starts the expandable portion 43 takes the position shown in FIG. 2, while the annular portion 46 embraces laterally the neck portion 47 of the cover 40. As gas evolves in the interior of the tank 10, the expandable portion 43 bulges upwardly and outwardly and takes a position shown in FIG. 3.

FIGS. 4 and 5 show a third embodiment of the cover 40, where the expandable portion 43 is formed as a diaphragm 48, which can be bulged inwardly (see FIG. 4) or outwardly (see FIG. 5). The expandable portion 43 can be formed as one-piece together with the neck portion 47. However, they can be glued or welded to one another with the intermediate portion 45 (for example in the form of the annular portion 46). It is true for both cases, that the cover 40 is gas- and liquid-proof.

FIGS. 6 and 7 show a fourth embodiment of the cover 40, which includes two parts, namely a hood 49 serving the function of the expandable portion 43 in the previous embodiments and an annular part 50 mounted on the cap 15. The hood 49 movably embraces the part 50 for telescopic movement relative to the part 50 under the pressure of gas evolving in the interior of the tank 10. The hood 49 is provided at its lower portion with a circumferential rim 51 extending inwardly towards the outer surface of the part 50. The part 50 in its turn is provided at the upper portion thereof with a corresponding circumferential rim 52 which extends outwardly toward the inner surface of the hood 49. When the hood 49 under the pressure of gas moves upwardly relative to the part 50, thus enlarging the interior of the tank 10. The rim 52 eventually abuts the rim 51 of the hood 49, thus preventing any further upward movement of the latter (see FIG. 7). The part 50 is provided with the sealing elements 42 designed, as it has been discussed before, to sealingly embrace the first sleeve 16 when the latter is in assembly with the part 50.

It is to be understood that the present invention is not limited by the embodiments shown in FIGS. 1–7. Different other variations can be accomplished without departing from the gist of the invention. For example, different embodiments of the covers have been discussed hereabove with respect to one and the same tank. However, the tank per se can have different shape and construction. For example, the discussed covers may be employed in a story tank for developing films. Such a story tank may include a tubular column with a plurality of spiral disc pairs. The story tank renders it possible to simultaneously develop therein a number of films. In this case, there must be formed a sufficient relationship between the required size of the pressure chamber and the dimensions of the expandable cover wall portion and the intermediate portion connecting the expandable wall portion to the side wall of the cover.

It will be understood that each of the elements described above, or two or more together, may also find a useful application in other types of tanks for developing color films differing from the types described above.

While the invention has been illustrated and described as embodied in a tank for developing color films, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a tank for developing film, a combination comprising a housing having an interior; a first cover on said housing and having passage means communicating with said interior for respectively introducing a developing liquid into and withdrawing the same from said interior; a second cover normally mounted on and closing said passage means of the first cover so as to prevent leakage of the developing liquid from the interior of said housing, said second cover being removable from said first cover to open said passage means for entry and exit of the developing liquid; and means for preventing the entry of light through said passage means into said interior of the housing upon removal of said second cover from said first cover, said second cover including a first circumferential portion operative to firmly embrace the wall of said first cover defining an opening communicating with said passage means and a second portion closing said opening, said second portion of the said cover being adapted to be bulged relative to said first portion when said cover is in assembly with said housing and subject to an internal pressure thus varying the interior volume of said housing.

2. A combination as defined in claim 1, wherein said second portion of said second cover is adapted to be bulged outwardly from the interior of the housing under the pressure of gas evolving in said interior thus enlarging the interior of the housing and compensating for the pressure exerted by gas therein.

3. A combination as defined in claim 2, wherein said second cover further includes a third portion operative for connecting said first and second portions.

4. A combination as defined in claim 3, wherein said third portion is bellows.

5. A combination as defined in claim 3, wherein said third portion is an annular portion having thickness smaller than that of said first and second portions.

6. A combination as defined in claim 2, wherein said second portion is a diaphragm.

7. A combination as defined in claim 1, wherein said first portion is integrally connected to said second portion of said second cover.

8. A combination as defined in claim 1, wherein said first cover includes a first insert sleeve and a second insert sleeve being concentric with said first sleeve and means for connecting said first and second sleeves to each other.

9. A combination as defined in claim 8, wherein said connecting means include at least one baffle extending through a circumferential gap between said first and second sleeves and connecting the same.

10. A combination as defined in claim 8, wherein said passage means include a circumferential elongated gap between said first and second sleeve, said preventing means including at least one inner light-penetration proof rim located on an inner surface of said first sleeve and extending circumferentially inwardly into said gap and at least one outer light-penetration proof rim located on an outer surface of said second sleeve and extending circumferentially outwardly into said gap.

11. A combination as defined in claim 10, wherein said one inner and outer rims are spaced one from the other along the elongation of said circumferential gap, said inner and outer rims being so shaped as to extend partially across the gap and to overlap one another.

12. A combination as defined in claim 8, wherein said second sleeve has a funnel-shaped bottom, and said preventing means including at least one annular light-penetration proof rib located at a lower end portion of the funnel-shaped bottom of said second sleeve.

13. In a receptacle, particularly in a tank for developing color film, a combination comprising a housing having an interior in which gas is likely to evolve, and an opening communicating with said interior; a removable cover normally closing said opening and tending to become dislodged from the same under the pressure of gas evolving in said interior, said cover including a first circumferential portion operative to firmly embrace the wall of said housing and constituting an annular member tightly mountable on said wall, and a second portion closing said opening and constituting a hood sealingly mounted on said annular member for telescopical movement relative thereto under the pressure of gas in said interior; means for preventing dislodging of said cover by compensating for the pressure exerted by gas evolving in said interior; means for limiting the displacement of said hood relative to said annular member and including a first circumferential rim provided on the inner surface of said hood at the lower end portion thereof and extending therefrom towards said annular member, the latter being provided with a second circumferential rim located at the upper end portion thereof and extending therefrom towards said hood, so that when said first rim during the movement of the hood respective to the annular member abuts said second rim further movement of said hood outwardly from the interior of the housing is interrupted.

* * * * *